US006162026A

United States Patent [19]

Kimura et al.

[11] Patent Number: 6,162,026

[45] Date of Patent: Dec. 19, 2000

[54] VARIABLE DISPLACEMENT TYPE COMPRESSOR

[75] Inventors: Kazuya Kimura; Kiyohiro Yamada; Suguru Hirota; Shiro Hayashi, all of Kariya, Japan

[73] Assignee: Kabushiki Kaisha Toyoda Jidoshokki Seisakusho, Aichi-ken, Japan

[21] Appl. No.: 09/200,686

[22] Filed: Nov. 27, 1998

[30] Foreign Application Priority Data

Nov. 27, 1997 [JP] Japan ..... 9-326430

[51] Int. Cl.[7] ..... F04B 1/26

[52] U.S. Cl. ..... 417/222.2; 417/270

[58] Field of Search ..... 417/222.2, 222.1, 417/270

[56] References Cited

U.S. PATENT DOCUMENTS

| | | | |
|---|---|---|---|
| 4,356,704 | 11/1982 | Izumi | 62/158 |
| 4,872,814 | 10/1989 | Skinner et al. | 417/222.2 |
| 4,990,987 | 2/1991 | Boucher et al. | 357/28 |
| 5,071,321 | 12/1991 | Skinner et al. | 417/222.2 |
| 5,653,119 | 8/1997 | Kimura et al. | 62/228.5 |
| 5,807,076 | 9/1998 | Kawaguchi et al. | 417/222.2 |

FOREIGN PATENT DOCUMENTS

| | | |
|---|---|---|
| 01077777 | 3/1989 | Japan . |
| 5296364 | 11/1993 | Japan . |

OTHER PUBLICATIONS

European Search Report application EP 98 12 2172.

Patent Abstract of Japanese Patent No. 06323248.

Patent Abstract of Japanese Patent No. 06346843.

Patent Abstract of Japanese Patent No. 07259732.

Japanese unexamined Utility Model Publication No. 61–162583.

Japanese unexamined Utility Model Publication No. 61–162584.

Japanese unexamined Patent Publication (Kokai) No. 1–203667.

Japanesse unexamined Utility Model Publication No. 1–159184.

*Primary Examiner*—Timothy S. Thorpe
*Assistant Examiner*—Michael K. Gray
*Attorney, Agent, or Firm*—Burgess, Ryan & Wayne; Milton J. Wayne; William R. Moran

[57] ABSTRACT

A reciprocating piston type compressor for compressing refrigerant gas for an automobile air conditioning system is improved to protect itself without protective control by a computer. The compressor detects the temperature of a part of the compressor in which the temperature increases to higher than a predetermined critical temperature when the compressor malfunctions, and changes a displacement control valve to reduce the displacement of the compressor when the detected temperature is higher than the predetermined critical temperature.

10 Claims, 4 Drawing Sheets

VARIABLE DISPLACEMENT TYPE COMPRESSOR

BACKGROUND OF THE INVENTION

1. Field of the Invention

The invention relates to a reciprocating piston type compressor for use in an automobile air conditioning system.

2. Description of the Related Art

A reciprocating piston variable displacement type refrigerant compressor for use in an automobile air conditioning system is known in the art. Such a compressor comprises a cylinder block including a plurality of parallel cylinder bores arranged around an axial drive shaft, and pistons slidably provided within the cylinder bores for reciprocating between the top dead center and the bottom dead center. The compressor is provided with a drive mechanism for reciprocating the pistons.

The drive mechanism comprises an axially extending drive shaft which is operatively connected to an automobile engine, and a swash plate which is provided within a crank chamber and is mounted on the drive shaft by a tilting mechanism for changing the angle of the swash plate relative to the drive shaft. The swash plate is engaged with the pistons through shoes mounted on the respective pistons.

The crank chamber is fluidly communicated with a high pressure source, for example the discharge pressure of the compressor, through a solenoid type displacement control valve. A computer controls a solenoid driver connected to the solenoid valve, according to a cooling load demand.

When the cooling load demand is relatively high, the solenoid driver increases the electric current supplied to the solenoid valve so that the solenoid valve operates to decrease the degree of opening, which results in decreasing the pressure in the crank chamber. Decrease in the crank chamber pressure also decreases the differential pressure across the pistons, that is the differential pressure of the refrigerant gas between the crank chamber and a suction chamber so that the swash plate moves relative to the drive shaft to increase the stroke of the piston and the displacement of the compressor.

Recently, automobile engines have been produced which can operate at a high rotational speed. The higher the rotational speed of the automobile engine, the higher the rotational speed of the compressor. Operation of a compressor at a relatively high rotational speed and displacement makes the load of the compressor high.

Conventionally, in order to solve this problem, a computer provides a protective control for a compressor at high rotational speed of an automobile engine which is the power source for the compressor. A speed sensor detects the rotational speed of the automobile engine and the computer compares the detected speed with a reference speed. The computer further compares the current supplied to the solenoid valve with a reference current value. The computer will generate a signal to the solenoid driver to increase the electrical current to the solenoid valve when both the compared values are higher than the reference values. Thus, the displacement of the compressor decreases to reduce to the load of the compressor.

However, the above-mentioned prior art includes the following problems.

The protective control by a computer makes the program for controlling the compressor complex and increases the necessary memory capacity.

Generally, an overload is realized in a compressor when the compressor operates at high rotational speed and high displacement. However, some conditions prevent overload of the compressor even if a compressor operates at high rotational speed and high displacement. According to the prior art, the displacement of a compressor always decreases so that the compressor does not satisfy the cooling load when the compressor operates at high rotational speed and high displacement even when the compressor is not overloaded. On the other hand, according to the prior art, a compressor cannot reduce its displacement, if some condition results in overload, when the compressor operates at middle or low speed and displacement since in such a case, the computer does not provide the protective control.

Further, according to the prior art, when a driver circuit for the solenoid valve breaks down due to malfunction of a power source for the driver or short circuit in the driver, a current higher than the rated current may be supplied to the solenoid valve so that overheat or damage in the solenoid valve results. However, the prior art cannot prevent such an excess current since the computer controls the current to the solenoid based on the rotational speed and displacement of the computer.

SUMMARY OF THE INVENTION

The invention is directed to solve the prior art problems, and to provide a variable displacement type compressor improved to protect itself without the protective control by a computer.

According to the invention, there is provided a reciprocating piston type compressor for compressing refrigerant gas for an automobile air conditioning system The compressor comprises a cylinder block assembly which includes a plurality of axially extending cylinder bores arranged around the longitudinal axis of the cylinder block assembly, a crank chamber, a discharge chamber and a suction chamber;

a plurality of pistons slidably provided within the cylinder bares for reciprocation between the top and bottom dead centers, the inner wall of the cylinders and the end face of the pistons defining compression chambers, a low pressure refrigerant gas being introduced into the compression chambers through the suction chamber, and the compressed refrigerant gas being discharged to the discharge chamber;

an axially extending drive shaft for driving the motion of the reciprocating pistons, the drive shaft being mounted or attached to to the cylinder block assembly for rotation;

a swash plate which is provided in the crank chamber and mounted to the drive shaft for rotation with the drive shaft, the swash plate engaging the pistons to convert the rotation of the swash plate to the reciprocation of the pistons;

a tilting mechanism, mounted on the drive shaft, for allowing the swash plate to change its angle relative to the drive shaft, and for enabling the compressor to vary its displacement according to the differential pressure across the pistons, the swash plate being capable of moving between a minimum displacement position where the swash plate is substantially perpendicular to the drive shaft and a maximum displacement position where the swash plate moves out of the minimum displacement position at a predetermined angle relative to the drive shaft;

a displacement control valve for changing the differential pressure comprising a solenoid valve which includes a coil, a valve body, and an armature, connected to the valve body, for moving the valve body to change the degree of opening of the solenoid valve; and means for detecting the temperature of a part of the compressor which temperature increases to higher than a predetermined critical temperature when the compressor malfunctions, and for changing the displacement control valve so that the differential pressure decreases to reduce the displacement of the compressor when the detected temperature is higher than the predetermined critical temperature, the means reducing the electric current to the coil when the detected temperature is higher than the critical temperature.

DESCRIPTION OF THE DRAWINGS

These and other objects and advantages and further description will now be discussed in connection with the drawings in which.

DESCRIPTION OF THE PREFERRED EMBODIMENTS

Figure 1:
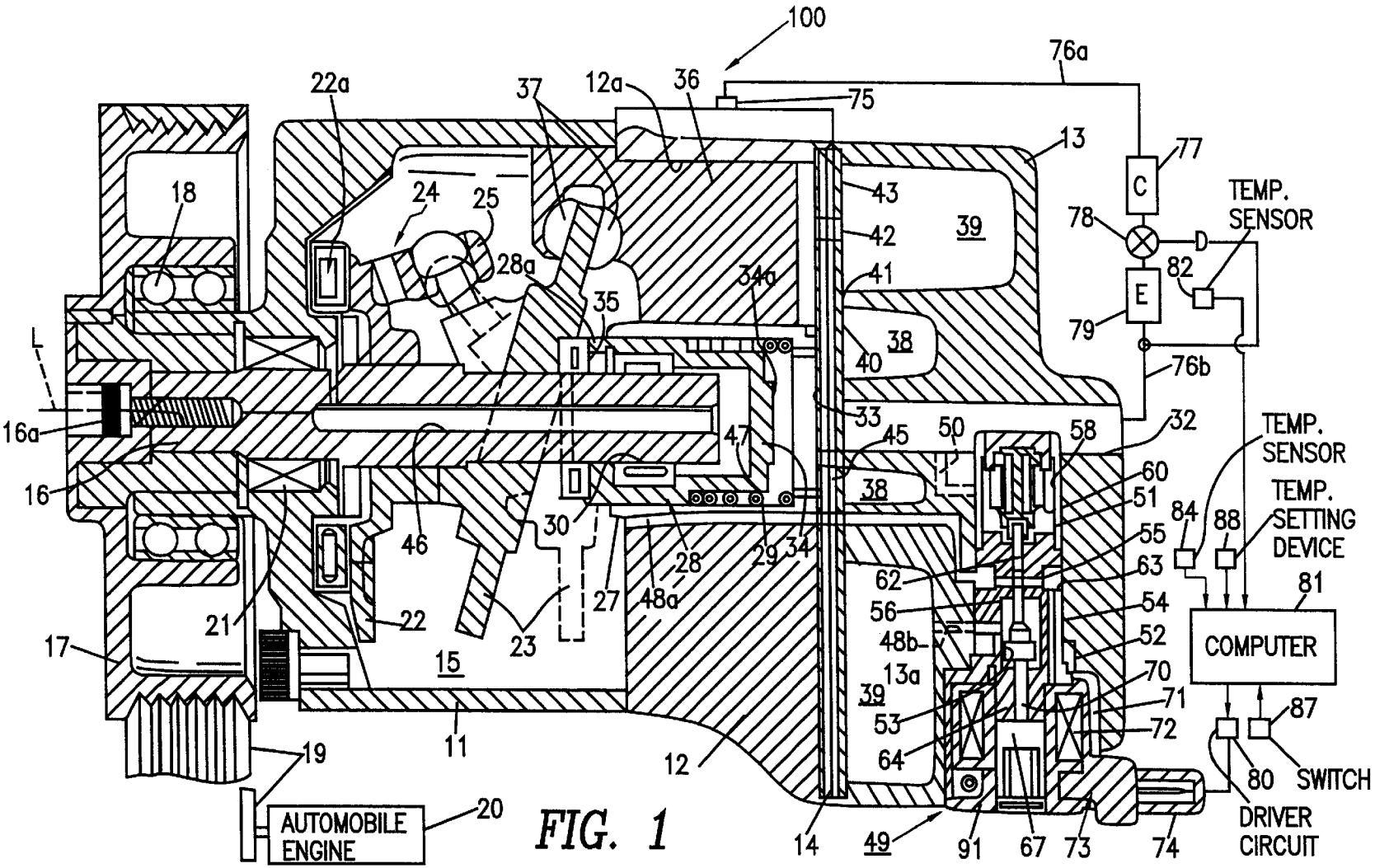
FIG. 1 is a longitudinal section of a compressor according to the embodiment of the invention.

FIG. 1 shows a reciprocating piston variable displacement type compressor 100, for compressing a refrigerant gas for an automobile air conditioning system according to an embodiment of the invention. The compressor 100 comprises a front housing 11 and a cylinder block 12 which are connected to each other to define a crank chamber 15 therebetween. The compressor 100 further comprises a rear housing 13 which is connected to the cylinder block 12 opposite to the front housing 11 with a valve plate 14 clamped therebetween. The cylinder block 12. the front housing 11 and the rear housing 13 provide a cylinder block assembly of the compressor 100.

A drive shaft 16 extends through the crank chamber 15 along the longitudinal axis "L", and is rotatably supported by the front housing 11 and the cylinder block 12. A sealing device such as a lip seal 21 is provided between the front housing 11 and the drive shaft 16.

Within the crank chamber 15, a swash plate 23 is mounted to the drive shaft 16 to rotate therewith. A tilting mechanism 24, for changing the angle of the swash plate 23 relative to the drive shaft 16, is provided on the drive shaft 16. The tilting mechanism 24 includes a supporting disk 22 which is mounted on the drive shaft 16 to rotate therewith, and a hinge mechanism 25 is provided between the swash plate 23 and the supporting disk 22. A thrust bearing 22*a* axially supports the supporting disk 22. The tilting mechanism 24 enables the swash plate 23 to move between a maximum displacement position, shown by the solid line in FIG. 1. and a minimum displacement position, shown by the dashed line in FIG. 1, where the swash plate 23 is substantially perpendicular to the drive shaft 16. However, actually, at the minimum displacement position, the swash plate 23 is inclined from a plane perpendicular to the drive shaft 16 so that pistons 36 reciprocate by a minimum stroke.

A pulley 17 is supported for rotation by the front housing 11 through a bearing 18, and is connected, at a front end of the drive shaft 16 by a screw bolt 16*a*, to rotate together with the drive shaft 16. Through the connection between the end of the drive shaft 16 and the pulley 17, the bearing 18 also supports the end of the drive shaft 16 for rotation. The pulley 17 is operatively connected to an automobile engine 20 through a plurality of belts 19.

The cylinder block 12 includes a central bore 27 within which a slider member 28 in the form of a cup is slidable. The slider member 28 includes an end wall 34 which defines an outer end face or an abutment face 34*a*, and an open end 28*a*. The slider member 28 receives the other end of the drive shaft 16 opposite to the pulley 17. The drive shaft 16 includes an axially extending passage 46 therein. The passage 46 opens, at one end thereof, into the inside of the slider member 28, and at the other end, into the crank chamber 15 adjacent to the lip seal 21. The slider member 29 includes an orifice 47 which fluidly connects the inside of the slider member 28 to the outside of the slider member 28.

A radial bearing 30, for rotationally supporting the and of the drive shaft 16, is provided between the outer surface of the drive shaft 16 and the inner surface of the slider member 28. The radial bearing 30 is slidable in the axial direction relative to the drive shaft 16 with the slider member 28. A spring 29 is provided between the slider member 28 and the central bore 27 for axially biasing the slider member 28 toward the swash plate 23.

The slider member 28 is capable of sliding, relative to the cylinder block 12 and the drive shaft 16, within the central bore 27 so that the abutment face 34*a* can contact with and separate from the inner end face 33 of the valve plate 14, as described hereinafter.

A thrust bearing 35 is provided between the swash plate 23 and the slider member 28 for sliding along the drive shaft 16. In particular, the thrust bearing 35 is clamped between the swash plate 23 and the slider member 28 which is biased toward the swash plate 23 by the spring 29. The thrust bearing 35 prevents the rotation of the swash plate 23 from being transferred to the slider member 28.

The cylinder block 12 includes a plurality of cylinder bores 12*a* which are equally spaced in the cylinder block about the axis of the drive shaft 16. Within the cylinder bores 12*a*, single-headed pistons 36 are slidably provided for reciprocation between top and bottom dead centers. The inner surfaces of the respective cylinder bores 12*a* and the ends of the single-headed pistons 36 define compression chambers.

The swash plate 23 engages the single-headed pistons 36 through shoes 37 which are attached to the respective pistons 36. Thus, the rotation of the drive shaft 16 is converted into the reciprocation of the single-headed pistons 36 within the cylinder bores 12*a* via the swash plate 23.

When the swash plate 23 is at the minimum displacement position where the swash plate is substantially perpendicular to the drive shaft 16, the slider member 28 moves right in FIG. 1 so that the abutment face 34*a* contacts the inner face 33 of the valve plate 14.

A suction passage 32 extends from the rear housing 13 and the valve plate 14 along the longitudinal axis "L" to open into the central bore 27. The suction passage 32 is locked or closed when the slider member 28 moves so that the abutment face 34*a* contacts the inner face 33 of the valve plate 14.

The compressor is connected to an automobile air conditioning system through high and low pressure conduits 76*a* and 76*b*. The air conditioning system includes a condenser 77 which is connected to an outlet port provided in a flange 75 of the compressor 100 to receive the compressed refrigerant gas, and an evaporator 79 connected to the suction passage to supply low pressure refrigerant gas to the compressor 100. The condenser 77 and the evaporator 79 are connected to each other through an expansion valve 78.

The rear housing 13 includes suction and discharge chambers 38 and 39 which are formed into an annular shape. The suction and discharge chambers 38 and 39 are fluidly connected to the compression chambers through suction and discharge ports 40 and 42, defined by the valve plate 14, respectively. The valve plate 14 includes suction and discharge valves 41 and 43. The valve plate 14 further includes an orifice 45 which provides fluid communication between the suction chamber 38 and the central bore 27.

The rear housing 13 further includes a valve receiving bore 13*a* for a displacement control valve 49 and a pressure detection passage 50 which extends between the suction passage 32 and the valve receiving bore 13*a*. A first control passage 48*a* extends through the cylinder block 12 and the rear housing 13 between the crank chamber 15 and the valve receiving bore 13*a*, and a second control passage 48*b* extends through the rear housing 13 between the valve receiving bore 13*a* and the discharge chamber 39.

The crank chamber 15 and the discharge chamber 39 are fluidly connected to each other through the control passages 48*a* and 48*b* and the displacement control valve 49 when the displacement control valve 49 is installed into the valve receiving bore 13*a*.

Figure 2:
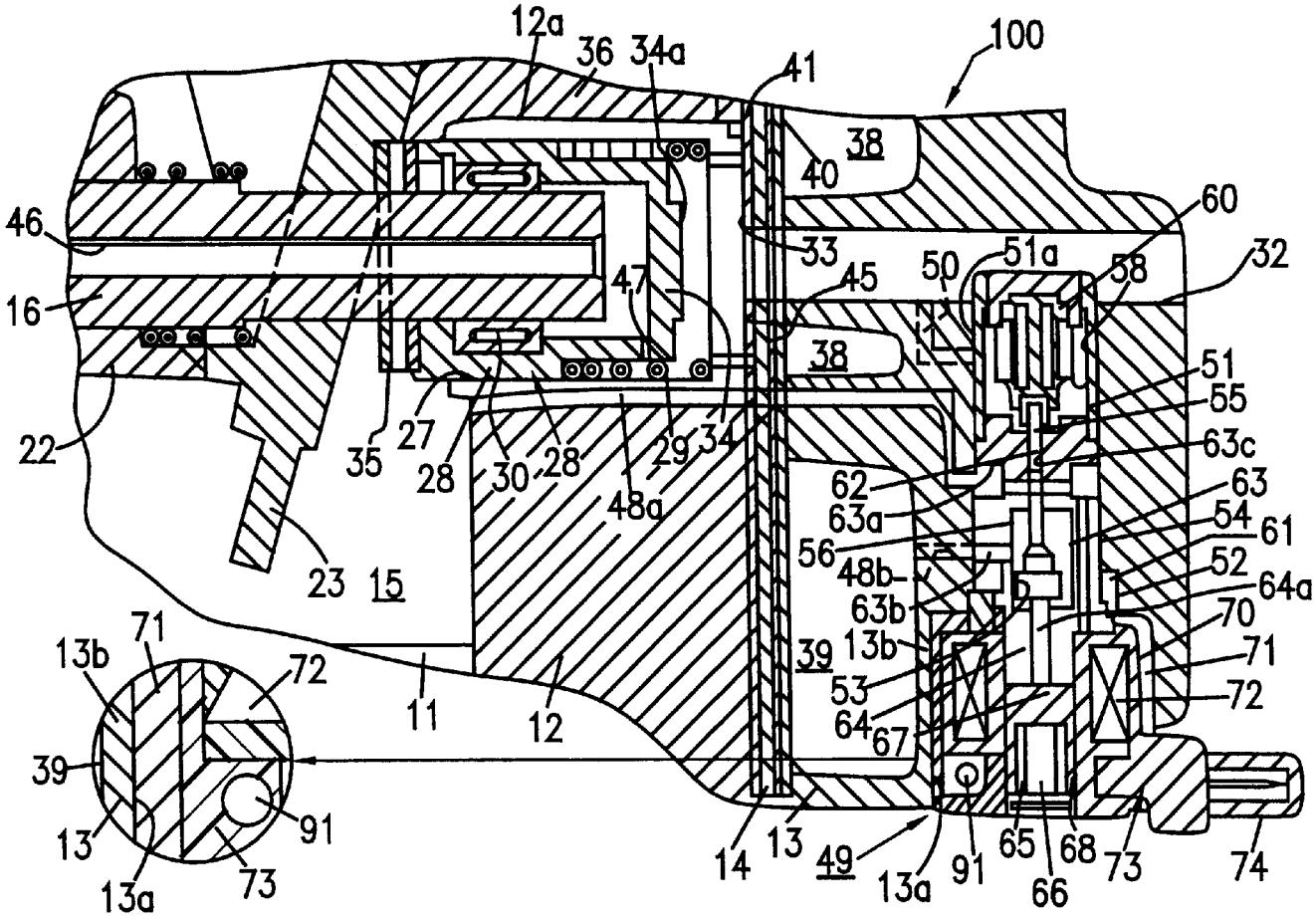
FIG. 2 is partially enlarged section of the compressor in FIG. 1, in which a displacement control valve is open, and the swash plate is at a maximum displacement position.
Figure 3:
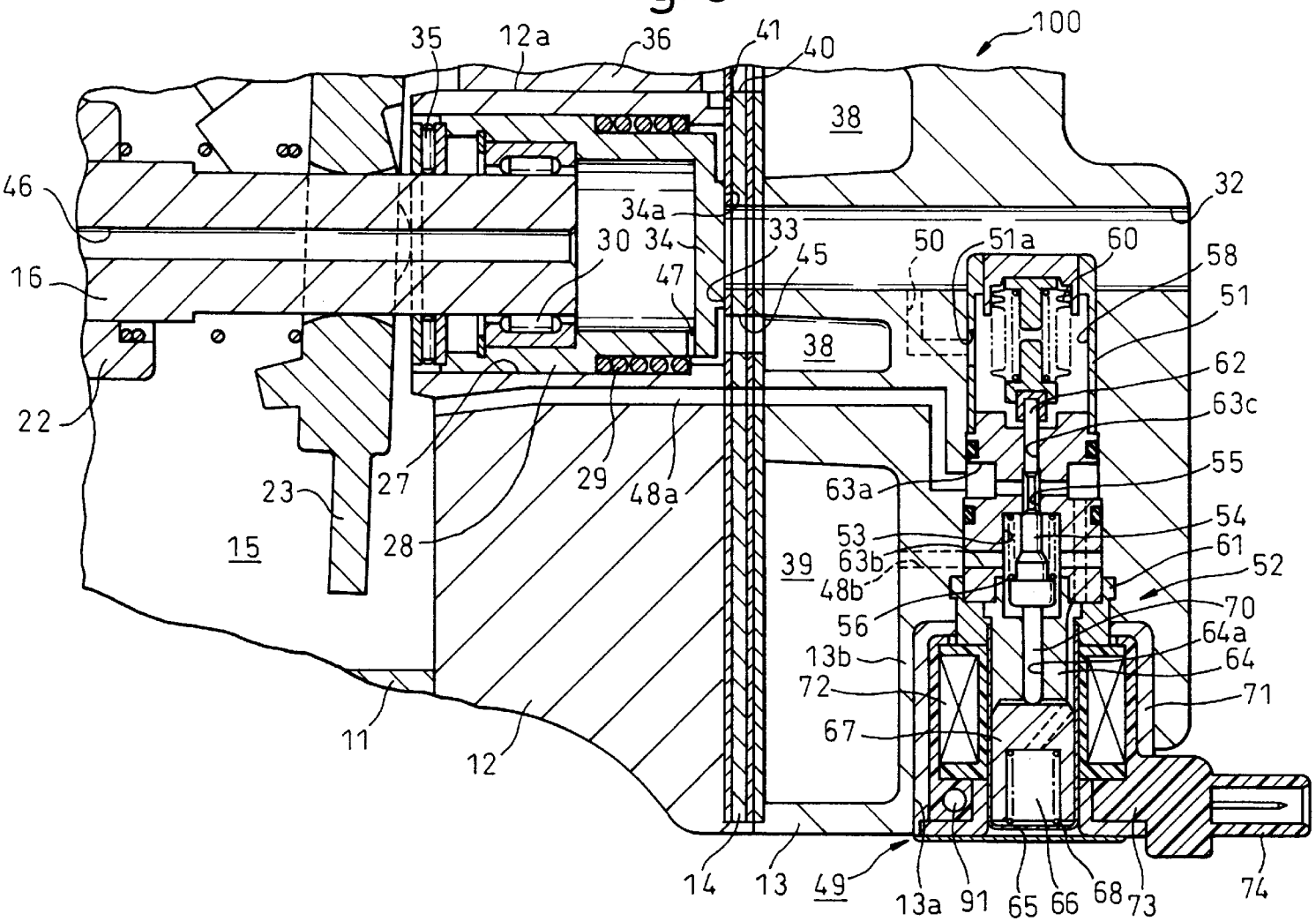
FIG. 3 is a partially enlarged section of the compressor, similar to FIG. 2, in which the displacement control valve is closed and the swash plate is at a minimum displacement position.

With reference to FIGS. 2 and 3, the displacement control valve 49 or solenoid valve includes a valve housing 51, which defines a pressure receiving chamber 58, and a solenoid 52 which are connected to each other by a cylinder member 63 and a sleeve 61. The valve housing 51 includes a port 51*a*. The pressure receiving chamber 58 fluidly communicates with the suction passage 32 through the pressure detection passage 50 and the port 51*a*. Within the pressure receiving chamber 58, bellows 60 is provided.

The cylinder member 63 includes radially extending first and second ports 63*a* and 63*b*, an axially extending central bore 63*c*, a valve orifice 55 aligned with the central bore 63*c*, and a valve chamber 53. The first and second ports 63*a* and 63*b* fluidly communicate with the crank chamber 15 and the discharge chamber 39 through the first and second control passages 48*a* and 48*b* respectively. The valve chamber 53 fluidly communicates with the first port 63*a* through the valve orifice 55. The valve chamber 53 further fluidly communicates with the discharge port 39 through the second port 63*b* and the second control passage 48*a*.

Within the central bore 63*c* of the cylinder member 63, a pressure responsive rod 62 is slidable in the axial direction of the cylinder member 63. One end of the pressure responsive rod 62 is connected to the bellows 60. The other end of the pressure responsive rod 62 abuts a valve body 54 which is provided in the valve chamber 53.

The solenoid 52 includes a solenoid housing 71 within which a case 65, for containing stationary and movable armatures 64 and 67, is provided. The stationary armature 64 is fixed to the sleeve 61 and includes an axially extending central bore 64*a*. The central bore 64*a* of the stationary armature 64 receives a solenoid rod 70. The solenoid rod 70 is connected, at one end thereof, to the valve body 54 to move therewith, and at the other end opposite to the valve body 54, abuts the movable armature 67. A valve spring 56 is provided about the valve body 54 to axially bias the valve body 54 toward the stationary armature 64.

The movable armature 67 aligns to the stationary armature 64 within the case 65, and includes a recess 66 within which a solenoid spring 68 is provided to axially bias the movable armature 67 toward the stationary armature 64.

Within the solenoid housing 71, a coil 72 is provided about the case 65 over both the stationary and movable armatures 64 and 67. Further, a thermistor 91 is disposed in the solenoid housing 71 adjacent to the coil 72 and the discharge chamber 39. A filler material 73 made of a resin fills the space in the solenoid housing 71 to secure the elements in the housing.

Figure 4:
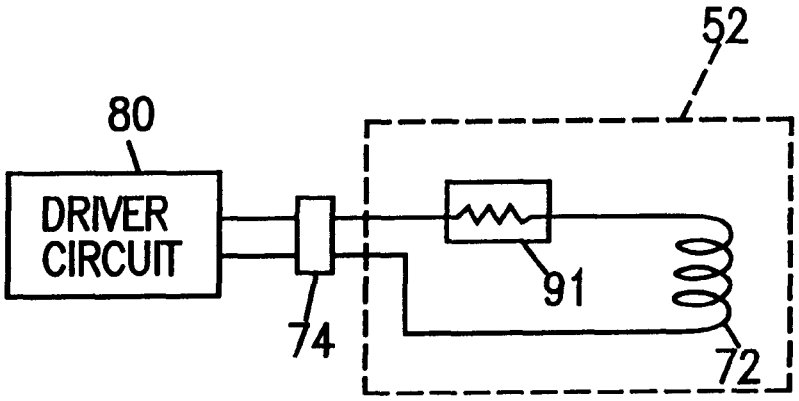
FIG. 4 is a schematic diagram of a connection between a driver circuit, a thermistor and a coil.
Figure 5:
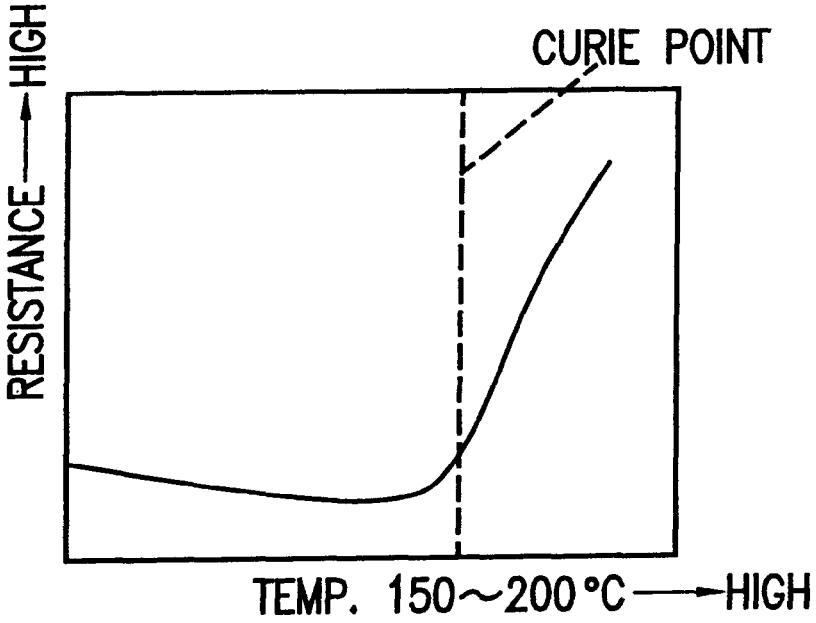
FIG. 5 is a graph of a change in electrical resistance of the thermistor.

The coil 72 and the thermistor 91 are connected to a driver circuit 80 for the solenoid 52 through a connector 74. In particular, with reference to FIG. 4, the thermistor 91 is provided between the coil 72 and a driver circuit 80 for the solenoid 52 in series. With reference to FIG. 5, the thermistor 91 has a characteristic that the electrical resistance thereof is drastically changes at the Curie Point, which is generally 150–200° C., in this particular embodiment. The thermistor 91 can be made of ceramic material, for example a barium titanate-based or a lead titanate-based ceramic.

The filler material 73 thermally couples the thermistor 91 to the coil 72 and the solenoid housing 71 so that heat is transmitted from the coil 72 effectively. Further, heat from the discharge chamber 39 is transmitted to the thermistor 91 through a wall i3*b* of the discharge chamber 39, the solenoid housing 71, and the filler material 73. In order to reduce the thermal resistance of the contact between the inner surface of the bore 13*a* and the outer surface of the solenoid housing 71, silicone grease may be applied to the contact surfaces.

The driver circuit 80 for the coil 72 is further connected to a computer 81 which controls the solenoid valve 49. Furthermore, a temperature sensor 82 for detecting the temperature of the evaporator 79, temperature sensor 84 for detecting the temperature of the automobile compartment, a switch 87 for the air conditioning system, and a device 88 for setting the temperature of the automobile compartment are connected to the computer 81. The computer 81 receives detection signals from the sensors 82 and 84, an on-off signal from the switch 87, and a temperature setting signal from the temperature setting device 88, and calculates the electrical current value for the coil 72. The computer 81 generates a control signal, based on the calculation, to the driver circuit 80 so that the calculated electrical current value is supplied to the coil 72 from the driver circuit 80. The higher the current is supplied to the coil 72, the greater the generated magnetic attractive force.

In use, the air conditioning system is activated when the switch 87 is on. The computer 81 delivers a command signal to the driver circuit 80 to energize the solenoid 52 when the temperature detected by the temperature sensor 84, which corresponds to the temperature in the automobile compartment, is higher than a reference temperature set by the temperature setting device 88. Thus, the driver circuit 80 supplies electric current to the coil 72 so that an attractive force corresponding to the duty ratio is generated between the stationary and movable armatures 64 and 67. The attractive force is transmitted to the valve body 54 through the solenoid rod 70 to move the valve body 54 away from the stationary armature 64, against the biasing force of the valve spring 56, so that the degree of opening of the passage between the discharge chamber and the crank chamber is reduced.

On the other hand, the bellows 60 extends corresponding to the pressure of the suction passage 32 transmitted through the pressure detection passage 50 and the port 51*a* to axially move the valve body 54. The valve body 54 is positioned by the balance between the biasing forces by the bellows 60, valve spring 56, solenoid spring 68 and the attractive force between the stationary and the movable armatures 64 and 67.

When the difference between the temperature detected by the sensor 84 and the reference temperature set by the device 88 is relatively large so that the cooling load is relatively large, the computer 81 delivers a command signal to the driver circuit 80 for changing the current to the coil 72 so that the displacement of the compressor 100 increases, corresponding to the temperature difference.

The larger the temperature difference, the greater is the current supplied to the coil 72 so that the attractive force between the stationary and movable armatures 64 and 67 increases to move the valve body 54 away from the stationary armature 64. This reduces the degree of opening of the solenoid valve 49. Thus, the flow rate of the refrigerant gas from the discharge chamber 39 to the crank chamber 15 through the second control passage 48*b*, the second port 63*b*, the valve chamber 53, the valve orifice 55, the first port 63*a* and the first control passage 48*a* decreases.

The low pressure in the suction chamber 38 draws the refrigerant gas from the crank chamber 15 through the passage 46 in the drive shaft 16, the orifice 47 in the slider member 28, the central bore 27 in the cylinder block 12, and the orifice 45 in the valve plate 14. Thus, the pressure in the crank chamber 15 decreases so that the differential pressure across the pistons 36, that is the differential pressure between the crank chamber 15 and the suction chamber 38, decreases. The decrease of the differential pressure moves the swash plate 23 to increase the displacement of the compressor 100.

When the valve orifice 55 is completely closed, the refrigerant gas supply to the crank chamber 15 is locked so that the pressure difference between the crank chamber 15 and the suction chamber 39 is substantially zero. Thus, the swash plate 23 moves to abut the supporting disk 22, as shown in FIG. 1, which results in the maximum displacement of the compressor 100.

On the other hand, when the difference between the temperature detected by the sensor 84 and the reference temperature set by the device 88 is relatively small so that the cooling load is relatively small, the computer 81 delivers a command signal to the driver circuit 80 for changing the current to the coil 72 so that the displacement of the compressor 100 decreases, corresponding to the temperature difference.

The smaller the temperature difference, the smaller is the current supplied to the coil 72 so that the attractive force between the stationary and movable armatures 64 and 67 decreases to move the valve body 54 toward the stationary armature 64. This increases the degree of opening of the solenoid valve 49. Thus, the flow rate of the refrigerant gas from the discharge chamber 39 to the crank chamber 15 increases.

The increased flow rate to the crank chamber 15 increases the pressure therein so that the differential pressure across the pistons 36, that is the differential pressure between the crank chamber 15 and the suction chamber 38,increases. This moves the swash plate 23 to reduce the displacement of the compressor 100.

When a cooling load decreases toward the no-load condition, the temperature in the evaporator 79 approaches the frosting point. The computer 81 monitors the temperature of the evaporator 79 through the temperature sensor 82 to deenergize the solenoid 52 when the temperature of the evaporator 79 decreases to a reference temperature which is determined in consideration of the actual frosting point. Deenergizing the solenoid 52 removes the attractive force between the stationary and movable armatures 64 and 67 to move the valve body to the stationary armature 64 due to the biasing force of the valve spring 56. This results in the maximum degree of opening of the solenoid valve 49, and in the maximum differential pressure across the pistons 36. Thus, the swash plate 23 moves to the minimum displacement position where the swash plate 23 is substantially perpendicular to the drive shaft 16.

The slider member 28 moves together with the swash plate 23 to the right in the drawings during the transition of the swash plate 23 to the minimum displacement position. The abutment face 34*a* contacts the end face 33 of the valve plate 14 to close the suction passage 32. Thus, no refrigerant gas is supplied to the suction chamber 38 from the external automobile air conditioning system.

As mentioned above, at the minimum displacement position, the swash plate 23 is substantially perpendicular to the drive shaft. 16. However, actually, the swash plate 23 is inclined from a plane perpendicular to the drive shaft so that the pistons 36 reciprocate with a minimum stroke. Thus, a minimum circulation of the refrigerant gas is generated in the compressor 100 through the compression chambers, the discharge ports 42, the discharge chamber 39, the control passage 48*b* and 48*a*, the crank chamber 15, the passage 46 in the drive shaft 16, the orifice 47 in the slider member 28, the central bore 27 in the cylinder block 12, and the orifice 45 in the valve plate 14. The circulation of the refrigerant gas provides lubrication for the elements in the compressor 100.

When an automobile engine, to which the compressor 100 is operatively connected, operates at a relatively high speed, the drive shaft 16 accordingly rotates at a relatively high speed. In such a case, if the compressor 100 operates at a high displacement, for example at the maximum displacement, the compressor 100 may be overloaded so that the temperature of the discharged refrigerant increases. The refrigerant gas in the discharge chamber 39 heats the elements, including the thermistor 91, adjacent to the discharge chamber 39. The current for the coil 72 will be drastically reduced by the thermistor 91 when the thermistor 91 is heated to the Curie point, about 150–200° C., since the electrical resistance of the thermistor 91 drastically increases, as shown in FIG. 5 to reduce the current to the coil 72. Thus, the displacement of the compressor 100 is reduced so that the over load on the compressor 100 is eliminated without providing a software protective control for the computer 81. Thus, the calculation load and the consumption of memory by the computer 81 are reduced.

According to the invention, overload of the compressor is determined by the temperature detected by the thermistor 91, unlike the prior art in which overload is determined based on the rotational speed of the drive shaft 16 and a calculated current value. Therefore, the compressor 100 can normally operate at high rotational speed and high displacement if some condition prevents an overload and the thermistor 91 does not detect a temperature higher than the Curie point. On the other hand, the compressor 100 can reduce its displacement, if some condition results in an overload, when the compressor 100 operates at a middle or low speed or displacement.

Further, the thermistor 91 can reduce the compressor displacement when an overload is detected if the computer 81 breaks down and keeps the compressor at high displacement because the thermistor 91 can reduce the current to the coil 72 of the displacement control valve 49 separately from the control of the computer 81.

Further, the thermistor 91 can detect a raised temperature of the coil 72, which may be realized when the driver circuit 80 breaks down due to malfunction of a power source for the driver or short circuit in the driver, and reduce the current to the coil 72 to prevent the overheat and the damage of the coil. The prior art cannot prevent such an excess current.

Further, according to the invention, the thermistor 91 is provided within the solenoid housing 71 which is inserted in the valve receiving bore 13*a*. This configuration reduces the effect of heat from the automobile engine 20 or other devices on the engine. Furthermore, the configuration prevents moisture, oil or dust in the engine compartment from changing the characteristics of the thermistor 91.

According to the invention, the thermistor 91 is provided adjacent to the discharge chamber 39 so that the thermistor 91 is capable of detecting that the temperature of the refrigerant gas in the discharge chamber 39 is higher than the Curie point, that is, an overload of the compressor 100.

Further, provision of the thermistor 91 does not change the configuration of the driver circuit 80, which allows the use of a conventional driver circuit as the driver circuit 80 without modification of the driver circuit and the computer.

It will also be understood by those skilled in the art that the forgoing description is a preferred embodiment of the disclosed device and that various changes and modifications may be made without departing from the spirit and scope of the invention.

For example, according to the embodiment, the displacement control valve 49 is provided in the rear housing 13. However, the displacement control valve 49 may be provided in the cylinder block 12 or the front housing 11. This configuration couples the thermistor 91 thermally to the cylinder block 12 or the front housing 11. Further, the thermistor 91 can be provided in the cylinder block 12 separately from the displacement control valve 49.

In general, the thermistor 91 can be thermally coupled to a portion which thermally represents an overload of the compressor. Such portions include the outlet port in the flange 75 of the compressor 100 and the conduit 76*a* connected to the outlet port through which the compressed refrigerant gas flows to the condenser 77.

In the compressor 100, according to the embodiment of the invention, the compressor displacement is controlled by controlling the refrigerant gas flow from the discharge chamber 39 to the crank chamber 15. However, the compressor displacement may be controlled by controlling the refrigerant gas flow from the crank chamber 15 to the suction chamber 38.

Instead of the thermistor 91, a switch, such as a bimetal switch, which can open at 150–200° C. to disconnect the coil 72 from the driver 80 may be provided.

We claim:

1. A reciprocating piston type compressor for compressing refrigerant gas for an automobile air conditioning system comprising:

a cylinder block assembly which includes a plurality of axially extending cylinder bores arranged around a longitudinal axis of the cylinder block assembly, a crank chamber, a discharge chamber and a suction chamber;

a plurality of pistons slidably provided within the cylinder bores for reciprocation within the cylinder bores, inner walls of the cylinder bores and end face of the pistons defining compression chambers, a low pressure refrigerant gas being introduced into the compression chambers through the suction chamber, and the compressed refrigerant gas being discharged to the discharge chamber;

an axially extending drive shaft for driving the motion of the reciprocating pistons, the drive shaft being mounted to the cylinder block assembly for rotation;

a swash plate is provided in the crank chamber arranged on the drive shaft for rotation with the drive shaft, the swash plate engaging the pistons to convert the rotation of the swash plate to the reciprocation of the pistons;

a tilting mechanism, mounted on the drive shaft, for allowing the swash plate to change its angle relative to the drive shaft to enable the compressor to vary its displacement according to a differential pressure across the pistons, the swash plate being capable of moving between a minimum displacement position where the swash plate is substantially perpendicular to the drive shaft and a maximum displacement position where the swash plate moves out of the minimum displacement position at a predetermined angle relative to the drive shaft;

a displacement control valve for changing the differential pressure between the suction chamber and the crank chamber comprising a solenoid valve which includes a coil, a valve body, and an armature, connected to the valve body, for moving the valve body to change the degree of opening of the solenoid valve to control the differential pressure; and means for detecting a temperature of a part of the compressor which temperature increases to higher than a predetermined critical temperature when the compressor malfunctions, and for changing the displacement control valve so that the differential pressure decreases to reduce the displacement of the compressor when the detected temperature is higher than the predetermined critical temperature; the means reducing an electric current to the coil when the detected temperature is higher than the predetermined critical temperature whereby the control valve decreases the differential pressure to reduce the displacement of the compressor.

2. A reciprocating piston type compressor according to claim 1 wherein the cylinder block assembly further includes a control passage between the crank chamber and the discharge chamber; and the solenoid valve is provided in the control passage.

3. A reciprocating piston type compressor according to claim 2 wherein the means for reducing the electric current comprises a thermistor in which an electrical resistance increases when the temperature of the thermistor is higher than the critical temperature.

4. A reciprocating piston type compressor according to claim 3 wherein the critical temperature is the Curie point of the thermistor which is a temperature of 150–200° C.

5. A reciprocating piston type compressor according to claim 2 wherein the cylinder block assembly further comprises front and rear housings connected to opposite ends of the cylinder block;

and wherein the means for reducing the current being arranged in the rear housing adjacent to the discharge chamber.

6. A reciprocating piston type compressor according to claim 5 wherein the means for reducing the current comprises a thermistor in which an electrical resistance increases when the temperature of the thermistor is higher than the critical temperature.

7. A reciprocating piston type compressor according to claim 6 wherein the critical temperature is the Curie point of the thermistor which is a temperature of 150–200° C.

8. A reciprocating piston type compressor according to claim 2 wherein the means is provided adjacent to the coil.

9. A reciprocating piston type compressor according to claim 8 wherein the means comprises a thermistor in which an electrical resistance increases when the temperature of the thermistor is higher than the critical temperature.

10. A reciprocating piston type compressor according to claim 9 wherein the critical temperature is the Curie point of the thermistor which is a temperature of 150–200° C.

* * * * *